US008613289B2

(12) United States Patent
Tameishi et al.

(10) Patent No.: US 8,613,289 B2
(45) Date of Patent: Dec. 24, 2013

(54) DISHWASHER WITH A REINFORCEMENT MEMBER

(75) Inventors: Yoshimasa Tameishi, Toyoake (JP); Kouji Suyama, Toyoake (JP); Mamoru Watanabe, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 838 days.

(21) Appl. No.: 12/033,658

(22) Filed: Feb. 19, 2008

(65) Prior Publication Data

US 2009/0205689 A1 Aug. 20, 2009

(51) Int. Cl.

| | |
|---|---|
| ***B08B 3/00*** | (2006.01) |
| ***B08B 3/12*** | (2006.01) |
| ***B08B 6/00*** | (2006.01) |

(52) U.S. Cl.
USPC ..... 134/186; 134/56 D; 134/57 D; 134/58 D

(58) Field of Classification Search
USPC ..... 134/58 D, 56 D, 57 D, 186
See application file for complete search history.

(56) References Cited

U.S. PATENT DOCUMENTS

| | | | | |
|---|---|---|---|---|
| 4,088,145 | A * | 5/1978 | Noren | 134/104.4 |
| 5,039,828 | A * | 8/1991 | Marks et al. | 174/135 |
| 5,357,992 | A * | 10/1994 | Yang | 134/107 |
| 6,484,738 | B1 * | 11/2002 | Andrews et al. | 134/201 |
| 2008/0092933 | A1 * | 4/2008 | Tameishi et al. | 134/133 |

FOREIGN PATENT DOCUMENTS

| | | | | |
|---|---|---|---|---|
| EP | 1719444 | A1 * | 11/2006 | |
| JP | 56-120149 | | 2/1980 | |
| JP | 62-146467 | | 9/1987 | |
| JP | 2003-19101 | | 1/2003 | |
| JP | 2004-313611 | A | 11/2004 | |
| JP | 2005-34376 | | 2/2005 | |
| JP | 2005-34447 | | 2/2005 | |
| JP | 2007111348 | A * | 5/2007 | |
| WO | WO 2005077245 | A1 * | 8/2005 | |
| WO | WO 2006075385 | A1 * | 7/2006 | ..... A47L 15/42 |

OTHER PUBLICATIONS

JP 2007-111348 Machine Translation.*
Esp@cenet patent abstract for Japanese Publication No. 2005034376, Publication date Feb. 10, 2005 (1 page).
Esp@cenet patent abstract for Japanese Publication No. 2003019101, Publication date Jan. 21, 2003 (1 page).
Esp@cenet patent abstract for Japanese Publication No. 2005034447, Publication date Feb. 10, 2005 (1 page).
Partial English translation of Japanese Utility Application No. 62-146467 (2 pages).

(Continued)

*Primary Examiner* — Michael Barr
*Assistant Examiner* — Charles W Kling
(74) *Attorney, Agent, or Firm* — Osha Liang LLP

(57) ABSTRACT

The present invention provides a dishwasher which permits cost reductions while enabling increased strength. A reinforcement member is mounted between pillars, which are erected in the corners of a machine chamber, and a functional part for executing washing and rinsing is fixed to the reinforcement member. Here, an example of the functional part is a washing pump for delivering washing water. Furthermore, another example for the functional part is a connecting part for connecting electrical wiring between a control box and a detergent supply device or a booster or the like.

8 Claims, 8 Drawing Sheets

(56) References Cited

OTHER PUBLICATIONS

Partial English translation of Japanese Utility Application No. 56-120149 (2 pages).

Patent Abstracts of Japan, Publication No. 2004-313611, published Nov. 11, 2004 (1 page).

Office Action for Japanese Application No. 2005-307475, dated Nov. 24, 2010, and English translation thereof (4 pages).

* cited by examiner

DISHWASHER WITH A REINFORCEMENT MEMBER

BACKGROUND OF THE INVENTION

1. Field of the Invention

The present invention relates to a dishwasher that washes and rinses dishes such as plates and cups.

2. Related Background Art

This type of conventional dishwasher includes the dishwashers which appear in Japanese Application Laid Open Nos. 2005-34447, 2003-19101, and 2005-34376, for example. In the dishwasher mentioned in Japanese Application Laid Open No. 2005-34447, a pillar is provided in each of the four corners of the machine chamber and panels are attached between the pillars. Furthermore, by mounting a plate-like reinforcement member between the pillars, the rigidity of the lower part of the dishwasher is raised.

In addition, in the case of the dishwasher mentioned in Japanese Application Laid Open No. 2003-19101, the appearance of a wired connection from the dishwasher main body to a separately installed hot-water heater is shown. Further, in the dishwasher mentioned in Japanese Application Laid Open No. 2005-34376, an aspect in which a rinsing water pump is attached to the side of a rinsing water tank is shown.

Japanese Application Laid Open No. 2005-34447 illustrates a reinforced member which is mounted between the pillars as mentioned earlier. This reinforcement member only structurally reinforces the dishwasher but there has been a need to combine this reinforcement with cost reductions by establishing some kind of association with parts in the machine chamber.

SUMMARY OF THE INVENTION

Therefore, an object of the present invention is to provide a dishwasher which permits cost reductions while enabling increased strength.

In order to achieve the object, the present invention is a dishwasher which washes and rinses dishes by injecting water from an injection nozzle disposed in a washing chamber, wherein a reinforcement member is mounted between pillars which are erected in the corners of a machine chamber disposed below the washing chamber, and a functional part for executing the washing and rinsing is fixed to the reinforcement member.

According to this constitution, the reinforcement member which is mounted between the pillars not only structurally reinforces the dishwasher but is also used to secure the functional parts which serve to execute the washing or rinsing of the dishwasher. The reinforcement member can therefore be utilized effectively.

Furthermore, with the abovementioned dishwasher, the functional part is a connection part of an electrical wiring and the reinforcement member is preferably disposed on an inner side of a detachable external panel which covers the machine chamber. According to this constitution, the reinforcement member which is mounted between the pillars is employed not only to structurally reinforce the dishwasher, but also to secure electrical wiring connection parts. In particular, the user is able to connect electrical wiring to electrical wiring connection parts which are secured to the reinforcement member by removing the external panel covering the machine chamber.

In addition, with the abovementioned dishwasher, the electrical wiring is preferably laid along an exterior side of the reinforcement member between the reinforcement member and the external panel. Thus, the electrical wiring laid along the outside of the reinforcement member is not susceptible to the influence of the electrical noise which is produced by the parts disposed on the inside the reinforcement member (the washing water pump, rinsing water pump, and so forth, for example).

Furthermore, with the abovementioned dishwasher, the functional part is preferably a washing pump which is linked by a water supply pipe and a discharge pipe to a washing water tank disposed in the machine chamber. With this constitution, the reinforcement member which is mounted between the pillars is used not only to structurally reinforce the dishwasher, but also to secure the washing pump which is linked to the water tank. Accordingly, the washing pump can be stably secured in order to suppress vibration and increase the strength of the dishwasher main body.

The present invention permits cost reductions while enabling increased strength.

DESCRIPTION OF THE PREFERRED EMBODIMENTS

Preferred embodiments of the dishwasher according to the present invention will be described in detail hereinbelow with reference to the drawings.

Figure 1:
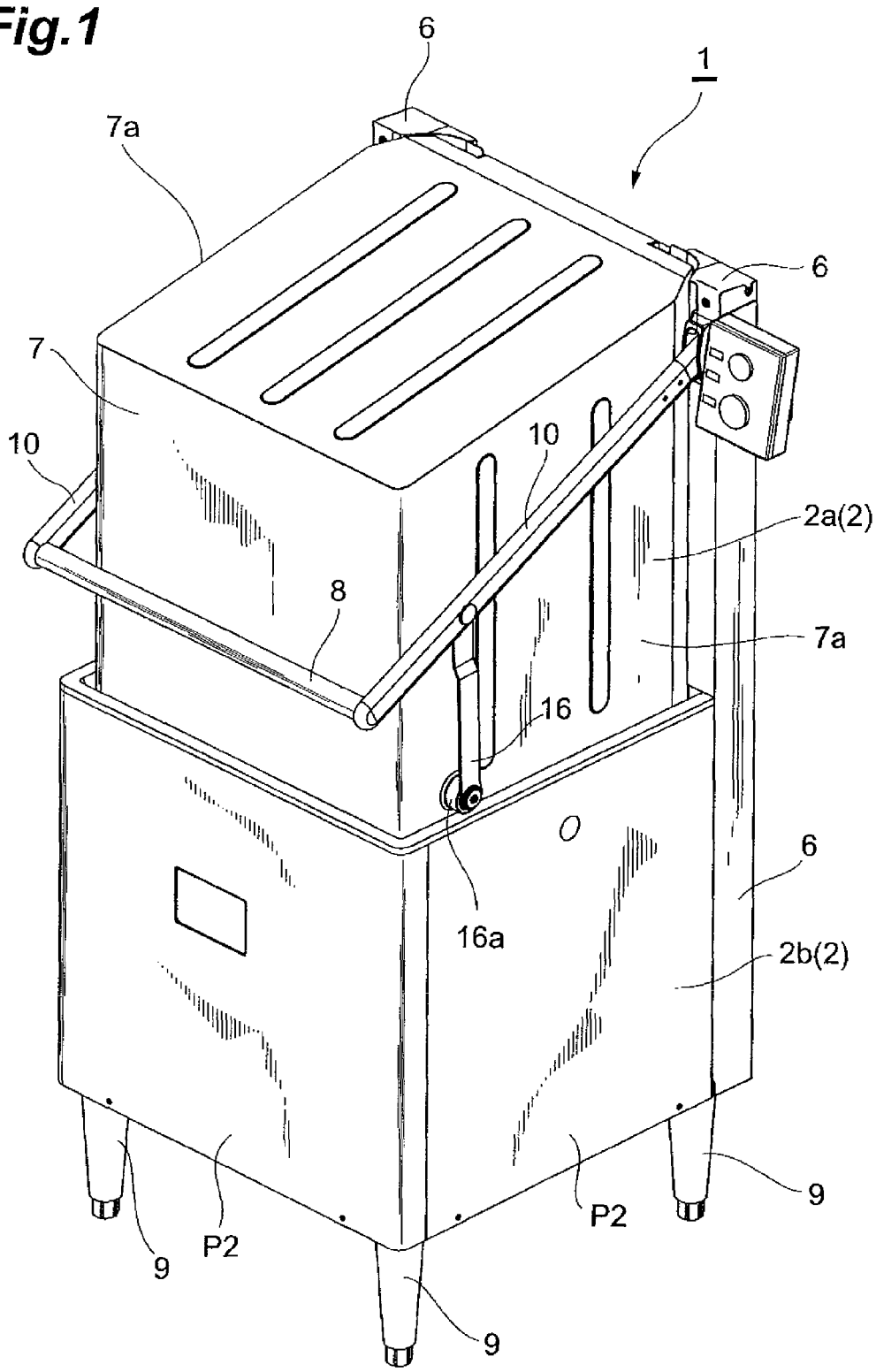
FIG. 1 is a perspective view of the outside of a dishwasher according to an embodiment of the present invention.
Figure 2:
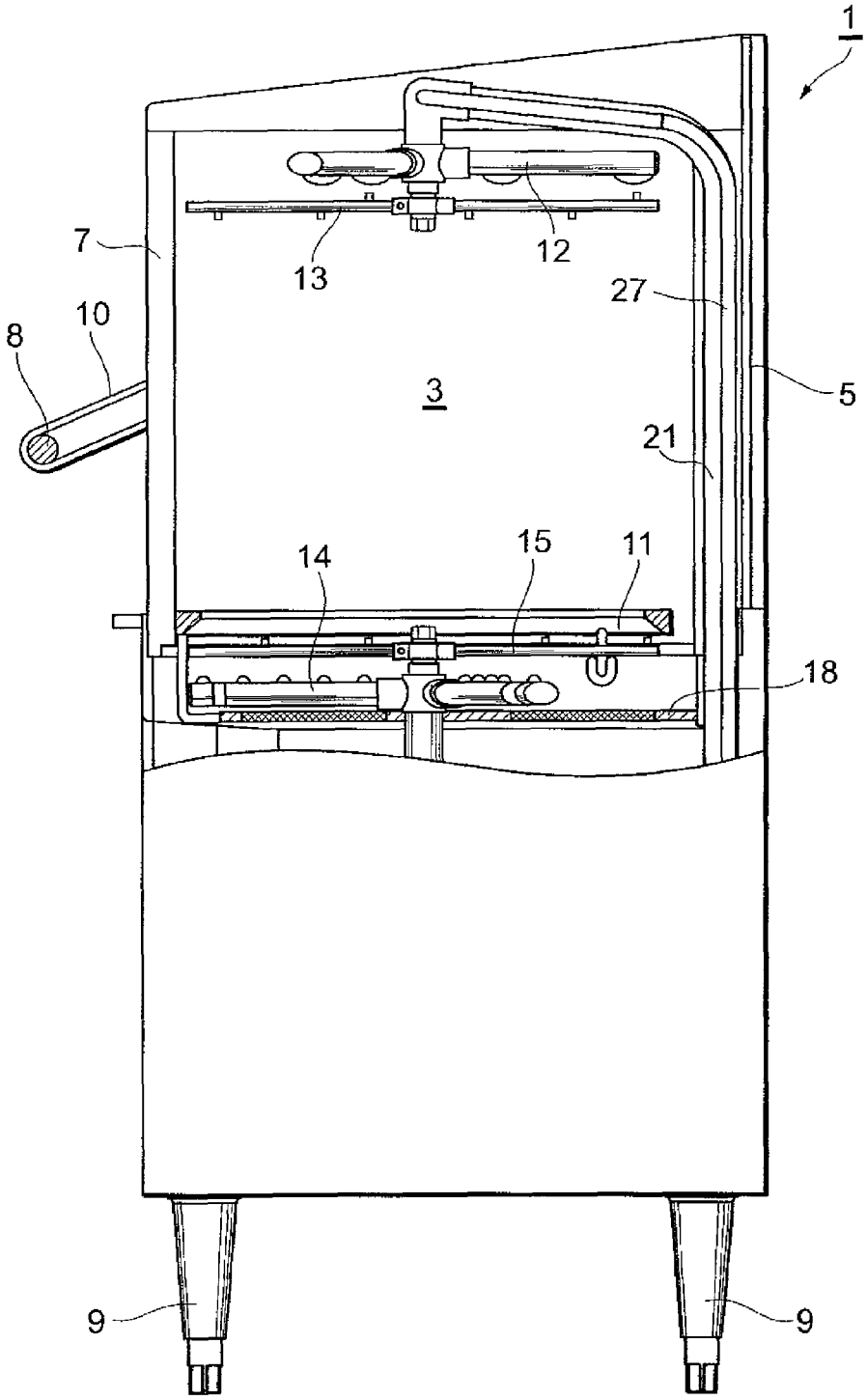
FIG. 2 is a cross-sectional view of the interior of the washing chamber of the dishwasher.

As shown in FIGS. 1 and 2, the dishwasher 1 comprises a stainless steel dishwasher main body 2. The dishwasher main body 2 is divided into an upper part 2*a* in which the washing chamber 3 is formed and a lower part 2*b* in which the machine chamber 4 (See FIG. 3) is formed. In addition, two pillars 6, 6, which extend in a vertical direction to span the upper part 2*a* and the lower part 2*b*, are disposed in the corners at the rear of the dishwasher main body 2 and a rear panel 5 extends between the pillars 6, 6.

Furthermore, a box-like door 7 for opening and closing the washing chamber 3 is provided in the upper part 2*a* of the dishwasher main body 2. This door 7 is guided in a vertical direction by a pair of left and right guide rails (not shown) which are disposed further on the inside than the pair of left and right stainless steel pillars 6, 6, and also can be made to move up and down by a handle 8 which extends in a horizontal direction at the front. The tips of a pair of left and right turning arms 10, 10 are fixed to both ends of the handle 8 and the turning arms 10 are each disposed diagonally along the sides 7*a* of the door 7. Further, in order to allow the door 7 to move up and down in response to the turning movement of the handle 8, the upper end of a link portion 16 which is disposed along the side 7*a* of the door 7 is rotatably linked to the turning arm 10 and the lower end of the link portion 16 is linked to the door 7 via the axis pin 16*a*. Leg portions 9 are attached to the four corners of the bottom of the dishwasher main body 2, whereby the dishwasher 1 can be afforded a stable installation.

A flip-type rack rail 11 is detachably disposed inside the washing chamber 3 and a lattice-like dish rack (not shown) in which dishes are aligned after being used for food and drink is placed on the rack rail 11. Furthermore, a rotatable upper washing nozzle 12 which comprises three arms that extend in radial fashion and a rotatable upper rinsing nozzle 13 which comprises two arms that extend in a linear fashion are concentrically disposed at the top inside the washing chamber 3. Similarly, a rotatable lower washing nozzle 14 and a lower rinsing nozzle 15 are concentrically disposed in the lower part in the washing chamber 3.

Figure 3:
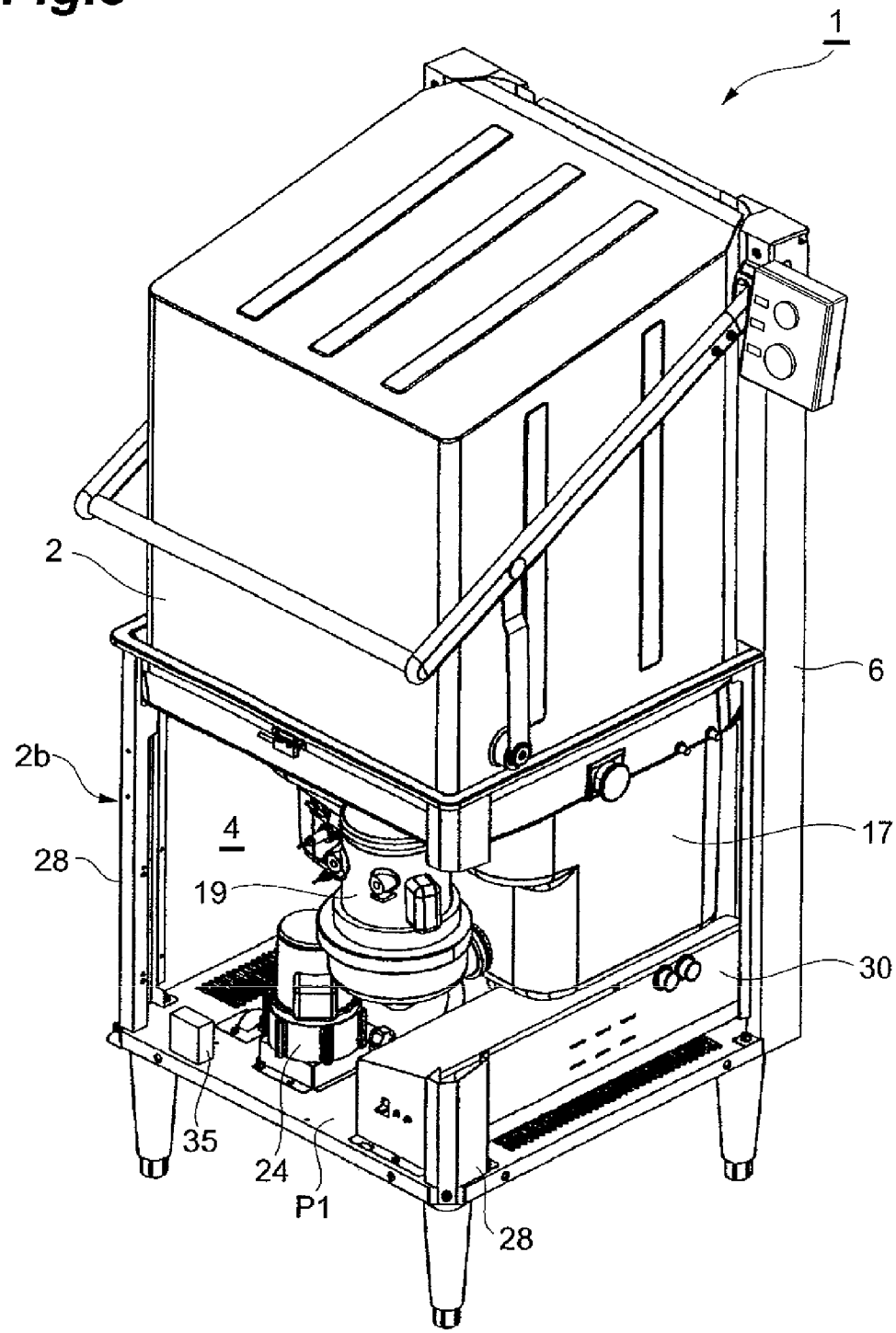
FIG. 3 is a perspective view of the interior of the machine chamber of the dishwasher.

Thereafter, as shown in FIG. 3, the machine chamber 4 is covered by stainless steel external panels P2 (See FIG. 1) which are disposed on the front side and on the left and right sides of the lower part 2*b* of the dishwasher main body 2. The external panels P2 can be detached from the dishwasher main body 2. FIG. 3 shows an aspect in which the external panels covering the front and right sides have been removed. While the rear side of the machine chamber 4 is supported by the abovementioned pillars 6, 6, the front side of the machine chamber 4 is supported by two pillars 28, 28 which are erected in the front corners. In FIG. 3, a portion of the pillar 28 which is erected in the front right-hand corner is shown cut away for the sake of convenience in describing the functional parts inside the machine chamber 4.

As shown in FIG. 3, the washing water tank 17 is provided in the machine chamber 4 so as to protrude from the side of the washing chamber 3. A washing water supply pump (called the 'washing pump' hereinbelow) 19 is provided on the front side of the washing water tank 17. The washing pump 19 is connected to a washing water flow pipe 21 (See FIG. 2) and the washing water flow pipe 21 is connected to the upper washing nozzle 12 and lower washing nozzle 14 through the inside of the washing water tank 17 and inside the washing chamber 3. Further, the washing pump 19 is a functional part for executing washing and rinsing which is disposed inside the machine chamber 4.

In addition, a rinsing water tank to which rinsing water is supplied from an external booster (not shown) is housed within the machine chamber 4 and the rinsing water supply pump (called the 'rinsing pump' hereinbelow) 24 is connected to the rinsing water tank. The rinsing water tank is on the left at the back of the machine chamber 4 but is in an unseen position in FIG. 3. The rinsing pump 24 is connected to the rinsing water flow pipe 27 (See FIG. 2) and the rinsing water flow pipe 27 is connected to the upper rinsing nozzle 13 and lower rinsing nozzle 15 via the interior of the washing water tank 17 and the interior of the washing chamber 3.

In addition, a control box 30 is disposed below the washing water tank 17 in the machine chamber 4. The control box 30 is disposed so as to extend in an front and rear direction within the machine chamber 4 and is fixed to the bottom plate P1 of the dishwasher main body 2. A control part for controlling the dish-washing and -rinsing operations of the dishwasher 1 is housed within the control box 30.

Furthermore, a detergent supply device 35 is fixed in the machine chamber 4 in a position close to the external panel P2 on the front side of the bottom plate P1 (See FIG. 1). The detergent supply device 35 stores liquid or powder detergent and supplies the detergent to the washing water in accordance with an instruction from the control part in the control box 30. Further, the detergent supply device 35 is a standard specification type of dishwasher 1 but a non-standard specification detergent supply device can also be attached to the dishwasher 1. Furthermore, although not shown, a rinsing aid supply device which supplies rinsing aid to the rinsing water can also be attached on the bottom plate P1 of the machine chamber 4.

Furthermore, as mentioned earlier, a booster (a warm water device, not illustrated) for supplying warm water to the dishwasher 1 is installed outside the dishwasher 1. The booster supplies water to the rinsing water tank after using electricity to raise the temperature of the water to the desired temperature. The booster is connected to the control part of the control box 30 via electrical wiring and exchanges information on the temperature, water level, operation timing, and errors and so forth with the control part. The booster can also be of the type which supplies water to the dishwasher 1 after raising the temperature of the water to the desired temperature by burning a combustible gas.

Figure 4:
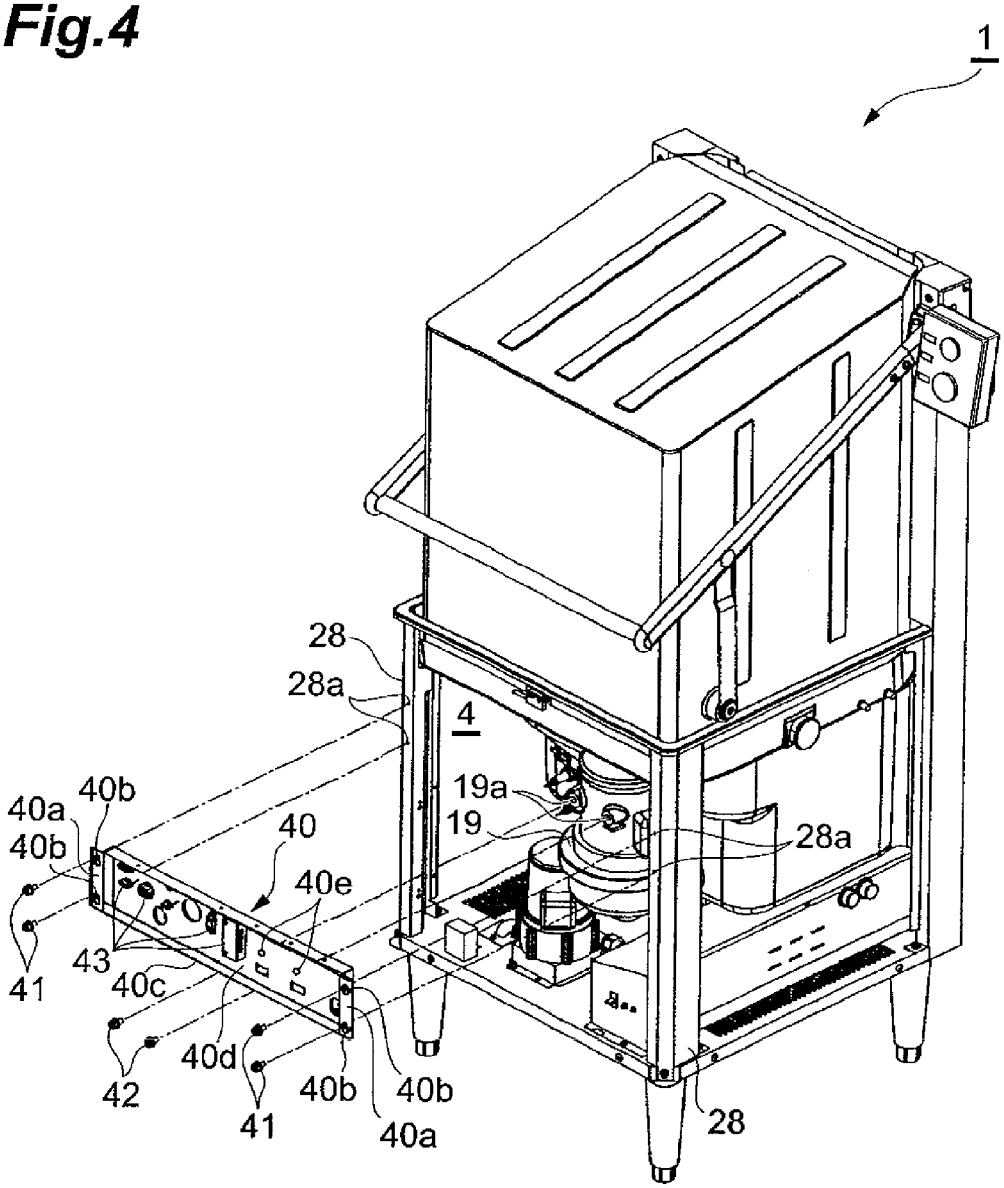
FIG. 4 is a perspective view of an aspect in which the reinforcement member is attached to the pillars.

The reinforcement member 40 which is mounted between the front pillars 28, 28 will be described next with reference to FIG. 4. FIG. 4 shows an aspect prior to the attachment of the reinforcement member 40 between the pillars 28, 28 at the front of the machine chamber 4. As shown in FIG. 4, the reinforcement member 40 is a beam-like member whose longitudinal direction is the horizontal direction. The reinforcement member 40 is formed by cutting a single steel plate substantially in a belt shape and then subjecting the edge of a steel plate to bending processing. Bolt holes 40*b* through which securing bolts 41 are to be inserted into threaded holes 28*a* formed in the pillars 28 are formed in the left and right end portions 40*a* of the reinforcement member 40. Further, the lower end portion 40*c* of the reinforcement member 40 is bent in a U shape and a conduit portion 40*c* which extends in a longitudinal direction of the reinforcement member 40 is formed. In addition, the center portion of the reinforcement member 40 is a flat portion 40*d* and through-holes 40*e* through which securing bolts 42 are inserted into threaded holes 19*a* which are formed in the washing pump 19 are formed in the right-hand part of the flat portion 40*d*. Meanwhile, a plurality of connecting parts 43 consisting of a connector or the like are fixed to the left-hand part of the flat portion 40*d*.

Figure 5:
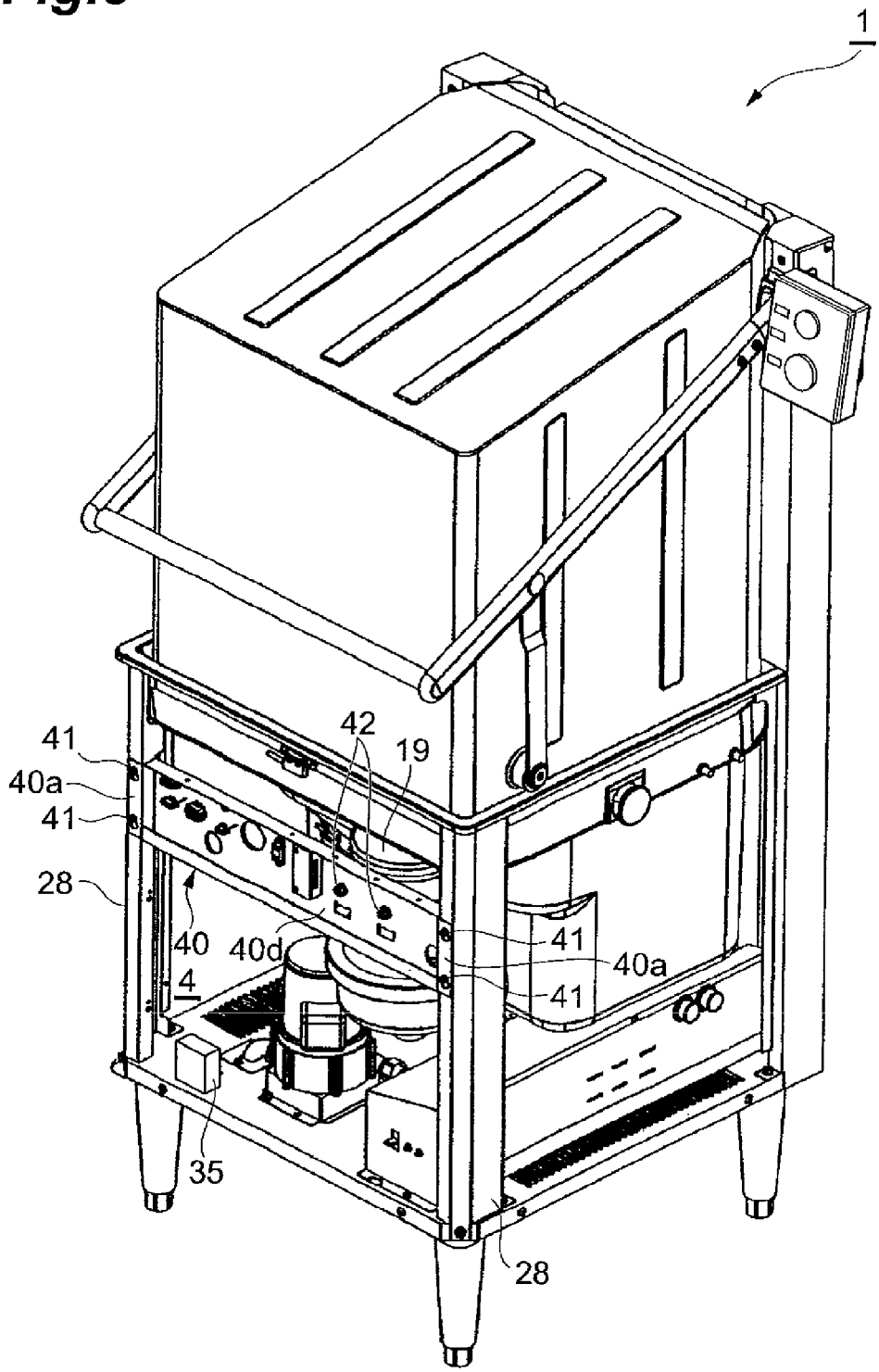
FIG. 5 is a perspective view of an aspect in which the reinforcement member is attached to the pillars.

FIG. 5 shows an aspect following the attachment of a reinforcement member 40 between the front pillars 28, 28 of the machine chamber 4. The left and right end portions 40*a* of the reinforcement member 40 are secured by screwing four securing bolts 41 into the threaded holes 28*a* formed in the pillar 28 and the reinforcement member 40 is thus stably fixed to the pillars 28. Meanwhile, by screwing two securing bolts 42 which are inserted in the through-holes 40*e* in the flat portion 40*d* of the reinforcement member 40 into threaded holes 19*a* which are formed in the washing pump 19, the washing pump 19 is stably fixed to the reinforcement member 40.

Figure 6:
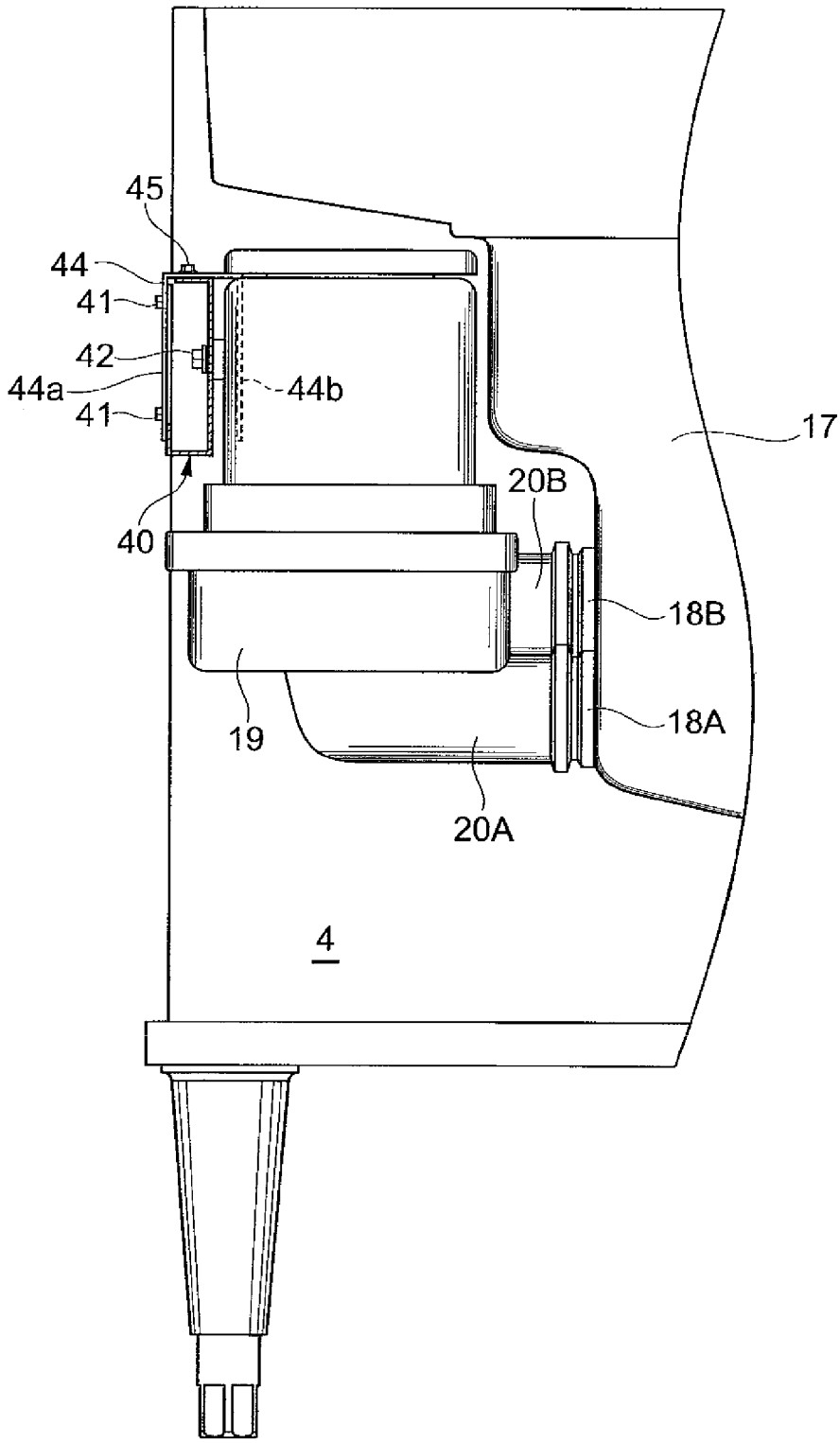
FIG. 6 is a side view which shows the dispositional relationship between the washing water tank, the washing pump and the reinforcement member.

FIG. 6 shows an aspect in which the washing pump 19 is supported by the washing water tank 17 and a reinforcement member 40. In FIG. 6, the washing pump 19, washing water tank 17 and reinforcement member 40 are viewed from the right side. A water supply pipe 20A and a discharge pipe 20B which protrude from the lower part of the washing pump 19 toward the washing water tank 17 are inserted in two respective pipe portions 18A and 18B which protrude from the side of the washing water tank 17. As a result of linking the washing water tank 17 and washing pump 19 such that the connection thereof takes the form of a dual pipe structure, the washing water tank 17 supports the washing pump 19 in a state which has a certain degree of stability. Further, as mentioned earlier, the upper part of the front of the washing pump 19 is fixed to the reinforcement member 40 by means of the bolt 42. Thus, as a result of the washing pump 19 being supported as a result of being fixed to the washing water tank 17 and reinforcement member 40, the washing pump 19 is installed in a stable state inside the machine chamber 4 and the vibration of the washing pump 19 is suppressed during operation. In the reinforcement member 40, the left part of the flat portion 40*d* to which a plurality of connecting parts 43 are fixed is covered from above by a cover 44 attached by means of a screw 45. The front part 44*a* of the cover 44 covers the front opening of the reinforcement member 40. Meanwhile, the rear part 44*b* of the cover 44 is disposed spaced apart from the reinforcement member 40 and covers the connecting parts 43 which protrude toward the rear side of the reinforcement member 40. By providing this cover 44, the water-proofness and dust-proofness in the vicinity of the connecting parts 43 can be improved.

Conversely, in cases where the washing pump 19 is not fixed to the reinforcement member 40 and where the washing pump 19 is only fixed to the washing water tank 17, when the washing pump 19 receives an external force, the washing pump 19 is dislodged from the washing water tank 17 and, therefore, a dedicated securing part such as a band or stay or the like for reliably fixing the washing pump 19 to the washing water tank 17 is required. Such a dedicated securing part only fulfils the simple role of securing the washing pump 19 and results in higher costs. Additionally, during the fabrication of the dishwasher 1, the step of securing the washing pump 19 by using the dedicated securing part is a separate step from the step of fixing the reinforcement member 40 between the pillars 28, meaning that there is a large number of assembly man-hours.

In contrast, in cases where the washing pump 19 is fixed to the reinforcement member 40 and washing water tank 17 as per the above embodiment, the reinforcement member 40 mounted between the pillars 28 not only structurally reinforces the dishwasher 1 but is also used to secure the washing pump 19 which is attached to the washing water tank 17. Accordingly, the washing pump 19 can be stably secured inside the machine chamber 4 without increasing the number of parts. In addition, during fabrication and installation of the dishwasher 1, because the reinforcement member 40 is only fixed to the pillars 28 and washing pump 19 after inserting the water supply pipe 20A and the discharge pipe 20B of the washing pump 19 in the pipe portions 18A and 18B of the washing water tank 17, the assembly man-hours can be reduced.

Furthermore, in addition to increasing the strength of the washing machine main body 2 by disposing the reinforcement member 40 between the pillars 28, 28, the strength of the dishwasher main body 2 can be markedly improved as a result of the washing water tank 17, washing pump 19 and reinforcement member 40 being fixed to one another. As a result, the thickness of the plate member which constitutes the structural parts (the pillars 28 and the reinforcement member 40 and so forth) which structurally support the dishwasher 1 can be made thinner, the processing to bend the structural parts is straightforward, and the welding area for reinforcing the structure of the dishwasher 1 can be reduced, which also contributes toward reduced costs. Although the washing pump 19 is fixed to the reinforcement member 40 using bolts in the above embodiment, the rinsing pump (functional part) 24 may also be fixed to the reinforcement member 40.

Figure 7:
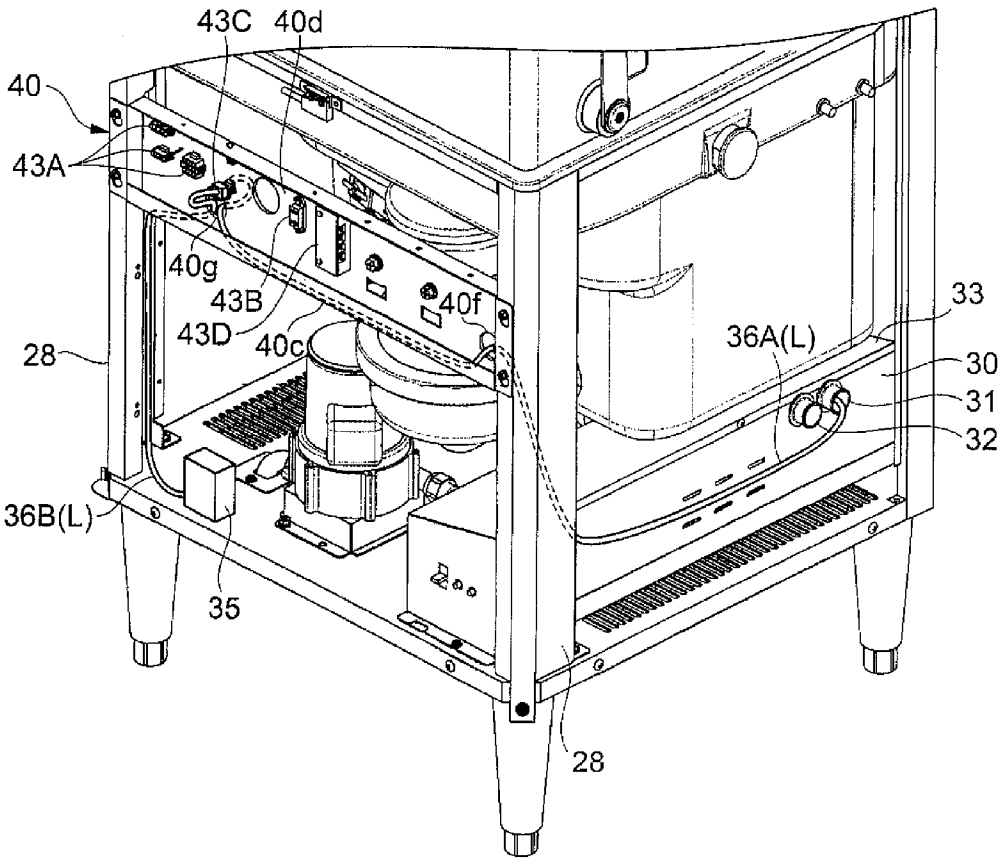
FIG. 7 is a perspective view of wiring which is laid within the machine chamber.

The connecting parts (functional parts) 43A, 43B, 43C, and 43D for connecting electrical wiring L which are fixed to the reinforcement member 40 will be described next with reference to FIG. 7. As mentioned earlier, a plurality of connecting parts 43A to 43D for connecting the electrical wiring L of the functional parts of the dishwasher 1 are fixed to the left part of the flat portion 40*d* of the reinforcement member 40. Here, the connecting part indicated by reference numeral 43A is a connector for connecting signal wire for controlling the booster. In addition, the connecting part indicated by reference numeral 43B is a 100V power source outlet for supplying power to the booster. Furthermore, the connecting part indicated by reference numeral 43C is a connector for connecting the power source supply wire and control signal wire of the standard specification detergent supply device 35. Furthermore, the connecting part indicated by reference numeral 43D is a terminal for connecting a power supply wire and a control signal wire of a non-standard specification detergent supply device. These connecting parts 43A to 43D are collectively fixed to the left part of the flat portion 40*d* of the reinforcement member 40 and their attachment is straightforward for a person skilled in the art.

Conversely, in cases where the work to connect the electrical wiring L is performed without fixing the connecting parts 43A to 43D of the electrical wiring L to the reinforcement member 40, a great number of man-hours is required to complete the work to connect the electrical wiring L. More specifically, after first removing the front panel P2, the control box 30 is drawn forward and the lid 33 of the control box 30 is removed. The person skilled in the art then connects one end of the electrical wiring L to a connector or terminal or the like which is used to connect the electrical wiring L in the control box 30, draws the electrical wiring L from the control box 30, and connects the other end of the electrical wiring L to the connector or terminal or the like of the booster, the detergent supply device 35, and the rinse aid supply device. In addition, after re-attaching the lid 33 of the control box 30, the person skilled in the art pushes the control box 30 into the machine chamber 4 and attaches the front panel P2. Furthermore, work to loosen and tighten a multiplicity of bolts and screws in accordance with this work is required.

In contrast, because the connecting parts 43A to 43D of the electrical wiring L are fixed to the reinforcement member 40 as mentioned earlier, electrical wiring L which is drawn from the control box 30 can be easily connected to the connecting parts 43A to 43D during the fabrication and installation of the dishwasher 1. Hence, in cases where the person skilled in the art performs work to connect the electrical wiring L, after removing the front panel, the person skilled in the art may connect the electrical wiring L which has been drawn from the booster, the detergent supply device 35, and the rinse aid supply device and so forth to the connecting parts 43A to 43D which are exposed in readily accessible positions at the front. The person skilled in the art is accordingly able to perform the work of wiring the electrical wiring L to the connecting parts 43A to 43D rapidly and in a straightforward manner.

In addition, in cases where the electrical wiring 36A is connected beforehand to the connecting parts 43A to 43D, since there is no need to perform work of withdrawing the control box 30 from the machine chamber 4 or removing the lid 33 on the control box 30, the inconvenience which arises as a result of such work can naturally be prevented. For example, the concerns with regard to incorrectly storing the control box 30 or forgetting to tighten the screws and so forth can be prevented. Furthermore, the connecting parts 43A to 43D of the electrical wiring L are not attached to parts which are prepared especially with the purpose of securing the connecting parts 43A to 43D but are instead attached to the reinforcement member 40 for structurally reinforcing the dishwasher 1. Hence, the number of parts does not increase, which is preferable from a cost standpoint.

The laid state of electrical wiring 36A and 36B between the control box 30 and detergent supply device 35 will be described next with reference to FIG. 7. FIG. 7 shows an aspect in which electrical wiring 36A is drawn from the control box 30 and extended to the connector 43C while the other electrical wiring 36B is drawn from the detergent supply device 35 and extended to the connector 43C. The electrical wiring 36A and 36B will be described in more detail hereinbelow.

Two insertion openings 31 and 32 which penetrate the control box 30 from inside of the control box 30 to the outside are provided in the side of the control box 30 and the electrical wiring 36A which is connected to the control part in the control box 30 is drawn from the first insertion opening 31. After extending forward from the insertion opening 31 to a point close to the front-right pillar 28, the electrical wiring 36A extends upward along the front-right pillar 28 before reaching the reinforcement member 40. The via hole 40*f*, which penetrates the flat portion 40*d* of the reinforcement member 40, is provided close to the right end of the reinforcement member 40 and the electrical wiring 36A is drawn from the underside of the reinforcement member 40 to the surface thereof after passing through the via hole 40*f*. Further, the electrical wiring 36A extends along the conduit portion 40*c* which is formed on the lower end of the reinforcement member 40. A via hole 40*g* which penetrates the flat portion 40*d* of the reinforcement member 40 is provided in the underside of the connector 43C of the reinforcement member 40 and the electrical wiring 36A is drawn from the surface of the reinforcement member 40 to the underside thereof after passing through the via hole 40*g* and is connected to the terminal portion on the underside of the connector 43C.

On the other hand, after being extended from the detergent supply device 35 to a point close to the front-left pillar 28, the electrical wiring 36B which extends from the detergent supply device 35 extends upward along the front-left pillar 28 before reaching the reinforcement member 40. The electrical wiring 36B is then drawn from the underside of the reinforcement member 40 to the surface thereof after passing through the via hole 40*g* and is connected to the terminal portion of the surface of the connector 43C. Thus, the control box 30 and detergent supply device 35 are connected by means of two electrical wirings 36A and 36B via the connector 43C.

A weak electrical line with a small capacity is used because an ON/OFF signal with a relatively small voltage difference on the order of DC12V or 24V is transmitted to the electrical wirings 36A and 36B which connect the control box 30 and detergent supply device 35. Accordingly, during the washing and rinsing operations, the ON/OFF signal which is transmitted via the electrical wiring 36A and 36B is affected by the washing pump 19 or the rinsing pump 24, whereby electrical noise is readily produced. In this regard, because the electrical wirings 36A and 36B are laid along the conduit portion 40*c* of the reinforcement member 40 between the reinforcement member 40 and external panel P2 as mentioned earlier, the flat portion 40*d* constitutes a protective wall and, therefore, the effect of the washing pump 19 or rinsing pump 24 is not felt and the production of electrical noise in the ON/OFF signal can naturally be prevented.

Figure 8:
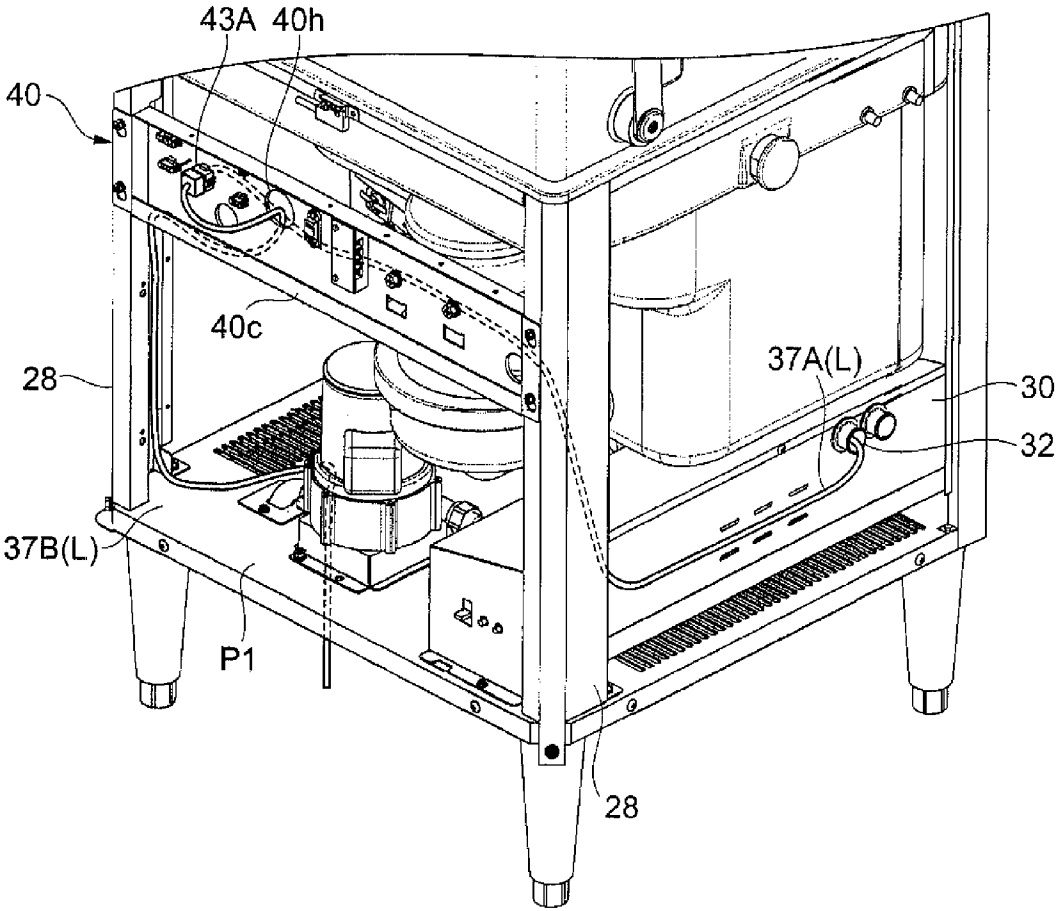
FIG. 8 is a perspective view of wiring which is laid within the machine chamber.

The laid state of the electrical wirings 37A and 37B between the control box 30 and the booster will be described next with reference to FIG. 8. FIG. 8 shows an aspect in which one electrical wiring 37A is drawn from the control box 30 and extends to the connector 43A while the other electrical wiring 37B is drawn from the booster (not shown) and extends to the connector 43A. The electrical wiring 37A and 37B will be described in more detail hereinbelow.

The electrical wiring 37A which is connected to the control part inside the control box 30 is drawn from the first insertion opening 32. After extending forward from the insertion opening 32 to a point close to the front-right pillar 28, the electrical wiring 37A extends upward along the front-right pillar 28 before reaching the reinforcement member 40. Further, the electrical wiring 37A is extended to the left along the rear side of the reinforcement member 40 and is connected to the terminal portion on the underside of the connector 43A.

However, when the electrical wiring 37B which extends from the booster is passed from the via hole (not shown) formed in the bottom plate P1 of the machine chamber 4 into the interior of the machine chamber 4, the electrical wiring 37B rises along the front-left pillar 28 before arriving at the reinforcement member 40, is drawn from the underside of a via hole 40*h* formed in the reinforcement member 40 to the surface, and is connected to the terminal portion of the surface of the connector 43A. Thus, the control box 30 and booster are connected by means of electrical wiring 37A and 37B.

A signal with a relatively large voltage difference of AC 200V is transmitted to the electrical wiring 37A and 37B between the control box 30 and booster, and therefore a large-capacity power line is used. Accordingly, the signal transmitted via the electrical wiring 37A and 37B is barely subject to the effects of the noise produced by the washing pump 19 or rinsing pump 24 and, therefore, the electrical wiring 37A and 37B is laid on the underside of the reinforcement member 40 as mentioned earlier.

Although the washing pump 19 and connecting parts 43A to 43D are fixed to the reinforcement member 40 as functional parts in the above embodiment, other functional parts may also be fixed to the reinforcement member 40.

What is claimed is:

1. A dishwasher which washes and rinses dishes by injecting water from an injection nozzle disposed in a washing chamber, comprising:

a reinforcement member mounted between pillars which are erected vertically in corners of a machine chamber disposed below the washing chamber;

a functional part for executing the washing and rinsing fixed to the reinforcement member; and a washing water tank, wherein the functional part and the reinforcement member face each other in a horizontal direction, wherein the machine chamber comprises a bottom plate and external panels arranged on the bottom plate, wherein the reinforcement member is arranged above the bottom plate and inside the external panels, wherein the reinforcement member is fixed to a first side of the functional part, wherein the washing water tank is disposed in proximity to a second side of the functional part, wherein the first side of the functional part is directly opposite to the second side of the functional part, and wherein the functional part is a washing pump.

2. The dishwasher according to claim 1, further comprising a connection part of an electrical wiring, and the reinforcement member is disposed on an inner side of a detachable external panel which covers the machine chamber.

3. The dishwasher according to claim 2, wherein the electrical wiring is laid along an exterior side of the reinforcement member between the reinforcement member and the detachable external panel.

4. The dishwasher according to claim 1, wherein the functional part is a washing pump which is linked by a water supply pipe and a discharge pipe to the washing water tank disposed.

5. The dishwasher according to claim 4, wherein the reinforcement member supports the washing pump from a side surface thereof.

6. The dishwasher according to claim 1, wherein a space is arranged between the bottom plate and the reinforcement member.

7. The dishwasher according to claim 1, wherein the reinforcement member is connected with a part of the functional part, thereby supporting the functional part from a side surface thereof

8. The dishwasher according to claim 7, further comprising a structure configured to connect the reinforcement member with the part of the functional part.

* * * * *